US011223106B2

(12) United States Patent
Khripkov et al.

(10) Patent No.: US 11,223,106 B2
(45) Date of Patent: Jan. 11, 2022

(54) ANTENNA SYSTEM FOR A WIRELESS COMMUNICATION DEVICE

(71) Applicants: Huawei Technologies Co., Ltd., Shenzhen (CN); Alexander Khripkov, Helsinki (FI)

(72) Inventors: Alexander Khripkov, Helsinki (FI); Joonas Krogerus, Helsinki (FI); Arun Sowpati, Helsinki (FI); Zlatoljub Milosavljevic, Helsinki (FI)

(73) Assignee: HUAWEI TECHNOLOGIES CO., LTD., Shenzhen (CN)

( * ) Notice: Subject to any disclaimer, the term of this patent is extended or adjusted under 35 U.S.C. 154(b) by 28 days.

(21) Appl. No.: 16/753,513

(22) PCT Filed: Oct. 5, 2017

(86) PCT No.: PCT/EP2017/075385

§ 371 (c)(1),
(2) Date: Apr. 3, 2020

(87) PCT Pub. No.: WO2019/068331

PCT Pub. Date: Apr. 11, 2019

(65) Prior Publication Data

US 2020/0321688 A1 Oct. 8, 2020

(51) Int. Cl.

| | |
|---|---|
| ***H01Q 1/24*** | (2006.01) |
| ***H01Q 1/48*** | (2006.01) |
| ***H01Q 5/35*** | (2015.01) |

(52) U.S. Cl.

CPC ..... *H01Q 1/243* (2013.01); *H01Q 5/35* (2015.01)

(58) Field of Classification Search

None

See application file for complete search history.

(56) References Cited

U.S. PATENT DOCUMENTS

| | | | | |
|---|---|---|---|---|
| 8,493,272 | B2 | 7/2013 | Ollikainen et al. | |
| 8,907,853 | B2 * | 12/2014 | Ying | H01Q 1/243 343/702 |
| 9,236,659 | B2 * | 1/2016 | Vazquez | H01Q 9/145 |
| 9,350,069 | B2 * | 5/2016 | Pascolini | H01Q 1/243 |
| 9,413,058 | B1 | 8/2016 | Kuo et al. | |

(Continued)

FOREIGN PATENT DOCUMENTS

| | | | |
|---|---|---|---|
| CN | 107026326 | A | 8/2017 |
| EP | 3057176 | A1 | 8/2016 |

(Continued)

*Primary Examiner* — Tuan A Tran

(74) *Attorney, Agent, or Firm* — Slater Matsil, LLP

(57) ABSTRACT

An antenna system for a mobile device includes a first electrically conductive member having a plurality of segments including at least a first corner segment and a central segment that is disposed adjacent to the first corner segment. A dielectric material is disposed in a gap between the first corner segment and the central segment. A second electrically conductive member is disposed within the mobile device. A first end of the second electrically conductive member is connected to the first corner segment. A portion of the second electrically conductive member away from the first end is electrically connected to a first feeding portion. The central segment is connected to a second feeding portion.

20 Claims, 18 Drawing Sheets

(56) References Cited

U.S. PATENT DOCUMENTS

| | | | | |
|---|---|---|---|---|
| 9,431,693 | B2 * | 8/2016 | Kwak | H01Q 7/00 |
| 9,521,222 | B1 * | 12/2016 | Chiang | H01Q 1/243 |
| 9,577,315 | B2 * | 2/2017 | Li | H01Q 9/42 |
| 9,596,330 | B2 * | 3/2017 | Caballero | H04M 1/0266 |
| 9,673,507 | B2 * | 6/2017 | Ramachandran | H01Q 1/38 |
| 9,762,710 | B2 * | 9/2017 | Lee | H01Q 1/243 |
| 9,819,071 | B2 * | 11/2017 | Nguyen | H01Q 21/30 |
| 9,871,286 | B2 * | 1/2018 | Kang | H01Q 1/48 |
| 9,876,272 | B2 * | 1/2018 | Hu | H01Q 13/103 |
| 9,876,274 | B2 * | 1/2018 | Kim | H01Q 1/50 |
| 9,985,337 | B2 * | 5/2018 | Kang | H01Q 1/48 |
| 10,079,427 | B2 | 9/2018 | Wang et al. | |
| 10,186,755 | B2 | 1/2019 | Xiong et al. | |
| 10,218,396 | B2 * | 2/2019 | Son | H01Q 5/328 |
| 10,224,608 | B2 * | 3/2019 | Lee | H01Q 9/42 |
| 10,224,610 | B2 | 3/2019 | Zheng et al. | |
| 10,256,527 | B2 * | 4/2019 | Kim | H01Q 9/42 |
| 10,283,844 | B2 * | 5/2019 | Rajagopalan | H01Q 5/385 |
| 10,290,946 | B2 * | 5/2019 | Romano | H01Q 13/18 |
| 10,347,988 | B2 | 7/2019 | Wang et al. | |
| 10,522,909 | B2 * | 12/2019 | Martiskainen | H01Q 5/392 |
| 10,594,344 | B2 * | 3/2020 | Son | H04B 1/0483 |
| 10,707,579 | B2 | 7/2020 | Krogerus | |
| 2015/0333390 | A1 | 11/2015 | Peng et al. | |
| 2016/0049719 | A1 | 2/2016 | Tseng et al. | |
| 2016/0064820 | A1 | 3/2016 | Kim et al. | |
| 2016/0112551 | A1 | 4/2016 | Hung et al. | |
| 2016/0164169 | A1 | 6/2016 | Krogerus et al. | |
| 2016/0226144 | A1 | 8/2016 | Martiskainen et al. | |
| 2017/0033812 | A1 | 2/2017 | Son et al. | |
| 2017/0047639 | A1 | 2/2017 | Lee et al. | |
| 2017/0048363 | A1 | 2/2017 | Lee et al. | |
| 2017/0201010 | A1 | 7/2017 | Kim et al. | |

FOREIGN PATENT DOCUMENTS

| | | | |
|---|---|---|---|
| EP | 3576221 | A1 | 12/2019 |
| WO | 2015007952 | A1 | 1/2015 |
| WO | 2016000155 | A1 | 1/2016 |
| WO | 2016005659 | A1 | 1/2016 |
| WO | 2016064415 | A1 | 4/2016 |
| WO | 2016065630 | A1 | 5/2016 |
| WO | 2017092003 | A1 | 6/2017 |

* cited by examiner

ANTENNA SYSTEM FOR A WIRELESS COMMUNICATION DEVICE

CROSS-REFERENCE TO RELATED APPLICATIONS

This application is a national stage of International Application No. PCT/EP2017/075385, filed on Oct. 5, 2017, which is hereby incorporated by reference in its entirety.

TECHNICAL FIELD

The aspects of the present disclosure relate generally to wireless communication devices and more particularly to an antenna system for a wireless communication device.

BACKGROUND

Existing mobile antenna solutions for mobile device application generally provide low performance of the main antenna in 4×4 multiple input-multiple output (MIMO) operations. For example, in present mobile devices, MIMO capability (4×4 MIMO) is solved with separately allocated MIMO antennas and utilizing extra space within the mobile device. Generally, there is compromised performance due to collocation and on-ground location of the MIMO antennas. The low band performance is compromised due to the reduced size of the low band antenna in favour of the MIMO antennas. There is also poor isolation between MIMO antennas.

Current antenna systems for mobile communication devices do not provide for simultaneous multiband operation of multi-antennas with overlapping multibands. For example, 4×4 MIMO with carrier aggregation is not supported. The efficiency of the low band is typically undermined by the insufficient length of the bottom center metal frame in comparison with the low band antennas utilizing the entire width of the mobile device.

Antenna devices that utilize the exterior metal frame of the mobile device are generally not compatible with metal back covers for these mobile devices. The low-band resonance antenna is configured utilizing a conductive elongate member, which is connected to the exterior metal frame. As a result, these designs need to use back covers made of a dielectric material, such as glass, ceramic or plastic.

Accordingly, it would be desirable to be able to provide an antenna system for a mobile communication device that addresses at least some of the problems identified above.

SUMMARY

It is an object of the disclosed embodiments to provide an antenna system for a mobile communication device that provides independent antenna elements for multiband multiple-in multiple out (MIMO) operation. This object is solved by the subject matter of the independent claims. Further advantageous modifications can be found in the dependent claims.

According to a first aspect the above and further objects and advantages are obtained by an antenna system for a mobile device. In one embodiment, the antenna system includes a first electrically conductive member having a plurality of segments with at least a first corner segment and a central segment that is disposed adjacent to the first corner segment. A dielectric material is disposed in a gap between the first corner segment and the central segment. A second electrically conductive member is disposed within the mobile device. A first end of the second electrically conductive member is connected to the first corner segment. A portion of the second electrically conductive member away from the first end is electrically connected to a first feeding portion. The central segment is connected to a second feeding portion. The aspects of the disclosed embodiments provide an antenna system for a mobile device that has separate and independent MIMO antennas. The corner segment can form a low band antenna that is configured to radiate on multiple cellular frequency bands and the center segment can form a mid-to-high band antenna. The gaps in the frame improve the in-hand performance of the center mid-high band antenna.

In a possible implementation form of the antenna system according to the first aspect device the second electrically conductive member includes a segment that is disposed in a substantially parallel relationship relative to the central segment. The second electrically conductive member is configured as a low impedance feed of the first corner segment and radiates efficiently when close to the central segment and edges of the mobile device.

In a possible implementation form of the antenna system according to the first aspect as such or the previous implementation form, the mobile device comprises a metal chassis. One end of the first corner segment away from the central segment is electrically connected to the metal chassis. The clearance between the second electrically conductive member and the center antenna is maximized, which increases the efficiency of the center antenna. The antenna of the corner segment generates electromagnetic energy within a volume maximally distanced from the user's head and hand. Interaction with the user's tissues (head & hand) is minimized and the efficiency of the antenna of the corner segment is maximized.

In a further possible implementation form of the antenna system according to the first aspect as such the mobile device comprises a metal chassis. A dielectric material is disposed in a gap between one end of the first corner segment away from the central segment and the metal chassis. This allows for maximum clearance to be achieved between the low band antenna and the adjacent metal parts of the mobile device and open boundary conditions are defined in proximity to the corner areas of the mobile device.

In a further possible implementation form of the antenna system according to the first aspect as such or according to any one of the preceding possible implementation forms, the plurality of segments include a second corner segment disposed adjacent to the central segment, the central segment being disposed between the first corner segment and the second corner segment, a dielectric material being disposed in a gap between the second corner segment and the central segment, the second corner segment being connected to a third feeding portion. The aspects of the disclosed embodiments provide an antenna system for a mobile device that provides separate and independent antennas, such as a low band and two mid-high band antennas. The corner antennas of the mobile device provide an optimal coupling to chassis mode, thus maximizing antenna efficiency. The separate and independent antennas enable multiband 4×4 MIMO operation of the cellular communication networks.

In a further possible implementation form of the antenna system according to the preceding possible implementation form the mobile device comprises a metal chassis, wherein one end of the second corner segment away from the central segment is electrically connected to the metal chassis. The clearance between the second electrically conductive member and the center antenna is maximized, which increases the efficiency of the center antenna. The antenna of the corner segment generates electromagnetic energy within a volume maximally distanced from the user's head and hand. Interaction with the user's body tissues (head & hand) is minimized and the efficiency of the antenna of the corner segment is maximized.

In a further possible implementation form of the antenna system according to the first aspect, the mobile device comprising a metal chassis and a dielectric material is disposed in a gap between one end of the second corner segment away from the central segment and the metal chassis. This allows for maximum clearance to be achieved between the low band antenna and the adjacent metal parts of the mobile device and open boundary conditions are defined in proximity to the corner areas of the mobile device. The length of the antenna is maximized, enabling efficient operation at low-frequency bands, such as for example, Long Term Evolution Frequency Division Duplex (LTE FDD) band 12: 699-746 MHz or LTE Time Division Duplex (TDD) band 44: 703-803 MHz.

In a further possible implementation form of the antenna system according to the first aspect as such or according to any one of the preceding possible implementation forms of the first aspect the first electrically conductive member comprises a frame for the mobile device. The metal frame allows for the allocation of multiple antennas within the same volume. The open ends of the bottom antennas use one part of the metal ring on the bottom of the device, creating an optimum radio signal propagation environment. Separate and independent antennas enable multiband 4×4 MIMO operation of the cellular communication networks. The metal frame for the mobile device also assures mechanical strength and visually appealing design for the mobile device.

In a further possible implementation form of the antenna system according to the first aspect as such a second end of the second electrically conductive member is electrically connected to the second corner segment. When the second electrically conductive member is connected to both the first corner segment and the second corner segment, the effective length of the low band antenna is maximized and the antenna efficiency at the low frequency bands is maximized, such as for example, LTE FDD band 12: 699-746 MHz or LTE TDD band 44: 703-803 MHz.

In a further possible implementation form of the antenna system according to the first aspect as such or according to the preceding possible implementation form, a ground connection is disposed at a point on the segment that is a maximum distance from the first end of the second electrically conducting member. The ground connection allows the corner antenna to be configured as an inverted F-antenna.

In a further possible implementation form of the antenna system according to the first aspect as such or according to any one of the preceding possible implementation forms the central segment of the first electrically conductive member is disposed along a bottom side of the mobile device. The antennas generate electromagnetic energy within the volume maximally distanced from the user's head and hand. Interaction with the user's tissues (head & hand) is minimized, thus maximizing an efficiency of the antennas.

In a further possible implementation form of the antenna system according to the first aspect as such or according to any one of the preceding possible implementation forms the second electrically conductive member is formed by at least one conductive track on a dielectric part of the mobile device. The aspects of the disclosed embodiments provide mechanical strength and reliability for the mobile device.

In a further possible implementation form of the antenna system according to the first aspect as such or according to any one of the preceding possible implementation forms the first corner segment is disposed in a first corner area of the mobile device. A low band antenna in the corner of the mobile device advantageously provides an optimal coupling to chassis mode.

In a further possible implementation form of the antenna system according to the first aspect as such or according to the preceding possible implementation form the second corner segment is disposed in a second corner area of the mobile device. A corner antenna in the second corner of the mobile device advantageously provides an optimal coupling to chassis mode.

In a further possible implementation form of the antenna system according to the first aspect as such or according to one of the preceding possible implementation forms the metal chassis comprises a back cover of the mobile device. The aspects of the disclosed embodiments provide mechanical strength and a visually appealing design for the mobile device.

In a further possible implementation form of the antenna system according to the first aspect as such or according to any one of the preceding possible implementation forms an impedance loading circuit is connected to the second electrically conductive member. Separate and independent antennas enable multiband 4×4 MIMO operation of the cellular communication networks.

In a further possible implementation form of the antenna system according to the first aspect as such or according to any one of the preceding possible implementation forms the first electrically conductive member comprises at least one antenna contact member with at least one c-clip member and the second electrically conductive member comprises at least one c-clip contact point, wherein an engagement of the at least one antenna contact member and the at least one c-clip member electrically connects the first electrically conductive member to the second electrically conductive member. The aspects of the disclosed embodiments provide an efficient mechanical connection of the internal conductive structures to the metal frame parts and printed circuit board.

According to a second aspect, the above and further objects and advantages are obtained by a mobile device. In one embodiment, the mobile device comprises an antenna system according to any one of the preceding possible implementation forms.

These and other aspects, implementation forms, and advantages of the exemplary embodiments will become apparent from the embodiments described herein considered in conjunction with the accompanying drawings. It is to be understood, however, that the description and drawings are designed solely for purposes of illustration and not as a definition of the limits of the disclosed invention, for which reference should be made to the appended claims. Additional aspects and advantages of the invention will be set forth in the description that follows, and in part will be obvious from the description, or may be learned by practice of the invention. Moreover, the aspects and advantages of the invention may be realized and obtained by means of the instrumentalities and combinations particularly pointed out in the appended claims.

BRIEF DESCRIPTION OF THE DRAWINGS

In the following detailed portion of the present disclosure, the invention will be explained in more detail with reference to the example embodiments shown in the drawings, in which.

DETAILED DESCRIPTION OF ILLUSTRATIVE EMBODIMENTS

Figure 1A:
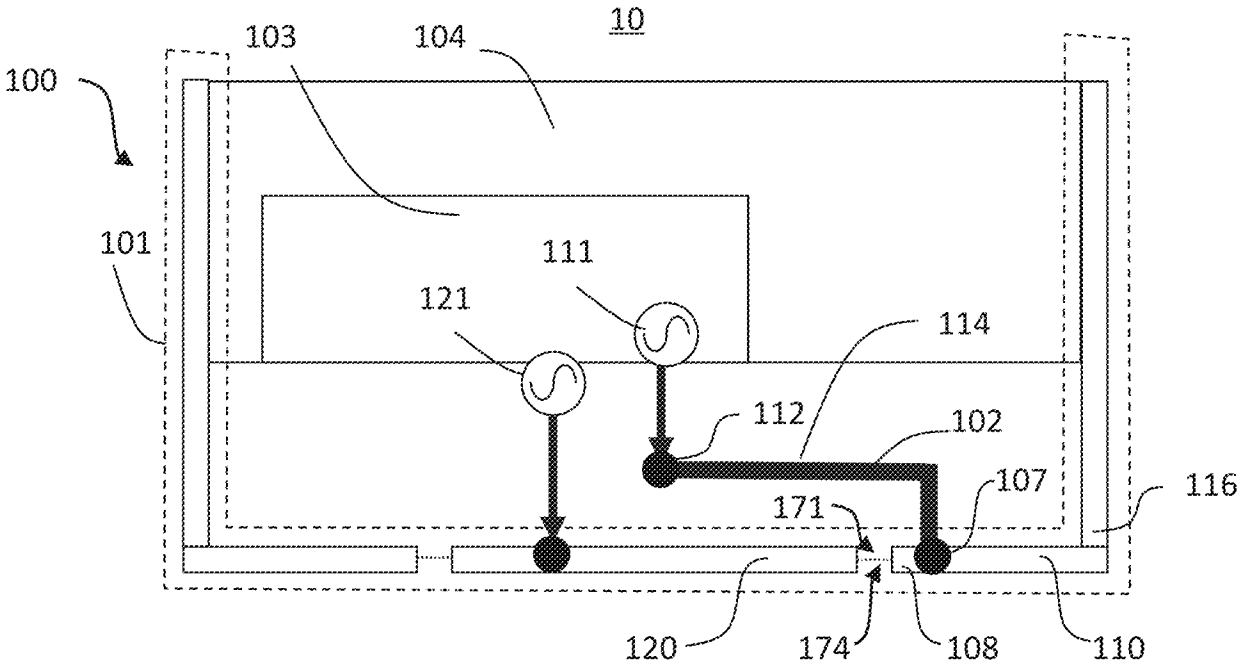
FIG. 1A is a block diagram illustrating an exemplary antenna system for a mobile device incorporating aspects of the disclosed embodiments.

Referring to FIG. 1A there can be seen an exemplary schematic block diagram of an antenna system 100 for a mobile communication device 10 incorporating aspects of the disclosed embodiments. The aspects of the disclosed embodiments provide an antenna system for a mobile device that has separate and independent multiple-input multiple-output (MIMO) antennas.

In the example shown in FIG. 1A, the mobile device 10 includes a metal chassis portion 104 with a metal frame member 101. The metal frame member 101, also referred to herein as a first electrically conducting member 101, generally comprises the electrically conducting members of the antenna system 100 incorporating aspects of the disclosed embodiments. The metal frame member 101 is made up of a plurality of segment-type metal frame parts or members. In one embodiment, the metal frame 101 can be used to provide structural support for the mobile device 10.

As is illustrated in the example of FIG. 1A, the plurality of segments of the metal frame 101 include at least a first corner segment 110 and a central segment 120. The central segment 120 is generally disposed substantially adjacent to the first corner segment 110. In one embodiment, the central segment 120 and the first corner segment 110 can form separate and independent MIMO antennas for the antenna system 100. In one embodiment, the first corner segment 110 of the metal frame member 101 comprises an antenna radiating element that can be configured to operate at cellular mid-high frequency bands. These corner segment antenna radiating elements are also referred to herein as corner antennas.

In one embodiment, the first corner segment 110 of the metal frame 101 can be configured to form a low band antenna that is configured to radiate on multiple cellular frequency bands. The central segment 120 can be configured to form a mid-to-high band antenna, also referred to as the center mid-high band antenna.

In one embodiment, a gap 174 is maintained between the first corner segment 110 and the central segment 120. A dielectric material 171 can be disposed in the gap 174. The dielectric material 171 can comprise any suitable dielectric material, such as for example, air. The gaps, such as gap 174 in the metal frame 101 generally improve the in-hand performance of the center mid-high band antenna.

As shown in FIG. 1A, the antenna system 100 includes a second electrically conductive structure or member 102, also referred to herein as an "internal conductive member." The second electrically conductive member 102 is configured to run along or adjacent to at least a portion of the exterior metal frame structure 101, such as the center part of the metal frame structure 101. The second electrically conductive member 102 can be formed as at least one conductive track on a dielectric part of the mobile device 10. For example, in one embodiment, the second electrically conductive member 102 can be formed on a printed circuit board 103 of the mobile device 10. Generally, the second electrically conductive member 102 will be disposed under the front glass cover or screen of the mobile device 10, above the bottom connector portions, for example.

In the example of FIG. 1A, the second electrically conductive member 102 is connected to the first corner segment 110. In alternate embodiments, the second electrically conductive member 102 can be connected to any suitable parts of the metal frame 101, such as another corner segment of the metal frame structure 101, as will be described herein.

For example, in one embodiment, a first end 107 of the second electrically conductive member 102 is connected to the first corner segment 110. A portion 112 of the second electrically conductive member 102 away from the first end 107 is electrically connected to a first feed portion or circuit in, also referred to herein as an RF feeding point. The portion 112 can be considered the end of the second electrically conductive member 102 opposing the first end 107. The RF feeding point 111 allows the internal conductive structure to be configured as a "low-band" antenna.

In the example of FIG. 1A, at least one second feed portion or circuit 121 is connected to the central segment 120 of the metal frame structure 101, also referred to herein as the center part 120. The central segment 120 can be configured as the "center" antenna.

The first feed portion or circuit in and the second feed portion or circuit 121 generally comprise RF circuits or feeds configured for different frequency bands and/or separate and independent MIMO antennas. The first feed portion in and the second feed portion 121 can comprise the same circuit on a single printed circuit board, such as circuit board 103, or be different circuits on the same or different printed circuit boards of the mobile device 10.

In one embodiment, a length of the second electrically conductive member 102 can be configured to be approximately equal to a quarter wavelength @ minimum frequency. For example 700 MHz→58 mm; 1700 MHz→24 mm. The second electrically conductive member 102 should generally be located close to edges of the mobile device 10 in order to radiate efficiently and should be positioned in a proximity to the central segment 120.

As shown in the example of FIG. 1A, at least a portion or segment 114 of the second electrically conductive member 102 is configured to be disposed in proximity to the central segment 120. In this example, the central segment 120 is disposed along a bottom portion of the mobile device 10. In the example of FIG. 1A, the segment 114 runs along and is disposed in a substantially parallel relationship relative to the central segment 120. The second electrically conductive member 102 is configured as a low-impedance feeding of the first corner segment 110. The length of the second conductive member 102 and the proximity of the second conductive member 102 to the edges of the mobile device 10 generally dictate the necessity of having a segment 114 that is disposed in a substantially parallel relationship relative to the central segment 120.

Figure 1B:
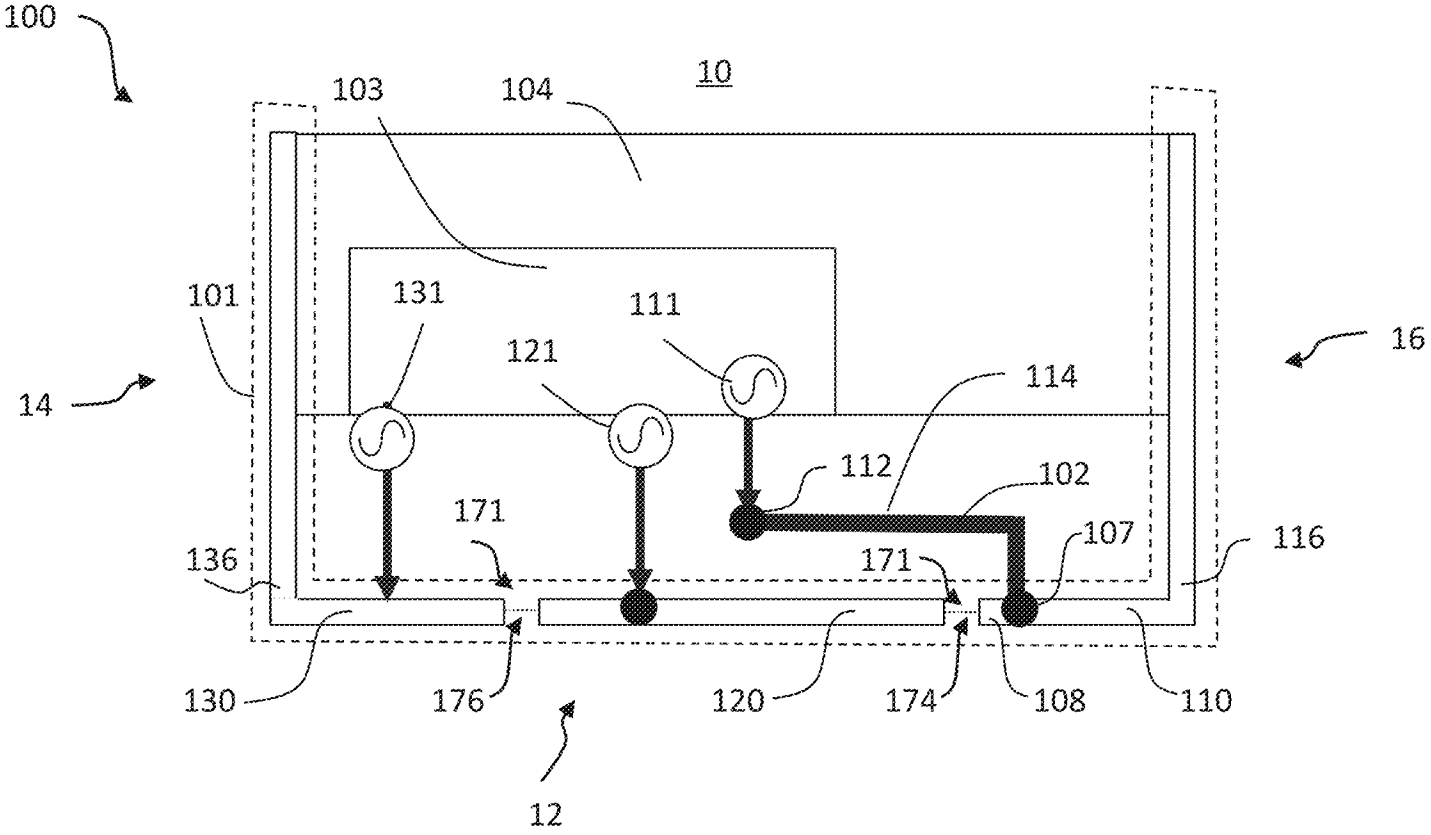
FIG. 1B is a block diagram illustrating another example of an exemplary antenna system for a mobile device incorporating aspects of the disclosed embodiments.

While the example of FIG. 1A generally describes two separate and independent antennas, the aspects of the disclosed embodiments are not so limited, in one embodiment, referring to FIG. 1B, the antenna system 100 can be configured to allocate three independent antennas at or near a bottom side 12 of the mobile device 10. The "bottom side" or portion of the mobile device 10, as the term is used herein and will be generally understood, generally refers to a side that is not in contact with the hand of the user while the phone is being used. As is generally understood, the tendency is to hold a phone along two sides, such as sides 14 and 16 in FIG. 1B, while using the mobile device 10, such as when holding the mobile device 10 to the ear. A side of the mobile device 10 that is not in contact with the user's hand in this usage position can be considered the bottom portion or side 12 of the mobile device 10.

In the example of FIG. 1B, the bottom portion or side 12 of the mobile device 10 includes three separate and independent antenna segments, generally comprising the first corner segment 110, the central segment 120 and another or second corner segment 130. The first corner segment 110 and the second corner segment 130 are generally formed as elongation of the metal frame 101 towards the corner areas of the mobile device 10. In the example of FIG. 1B, one side 108 of the corner segment 110 is in proximity to the central segment 120, while the other side 116 is conductively connected to the metal chassis 104.

The three separate and independent antenna segments, 110, 120 and 130, provide a better environment to match them independently and separately, such as for example, a low-band (LB) and two mid-high band (MHB) antennas. This enables optimal low-pass, high pass filter type matching circuits.

The corner, or low band antenna in FIG. 1B is formed by the second electrically conductive member 102 connected to at least one corner part 110 of the metal frame 101. This corner low band antenna 110 in the example of FIG. 1 can be configured to radiate at multiple cellular frequency bands.

The central segment 120 is connected to the second feed portion 121, while the second corner segment 130 is connected to the third feed portion or RF circuit 131 that is disposed on or part of the printed circuit board 103. A dielectric, such as the dielectric 171, fills the gap 176 between the central segment 120 and the second corner segment 130.

Figure 1C:
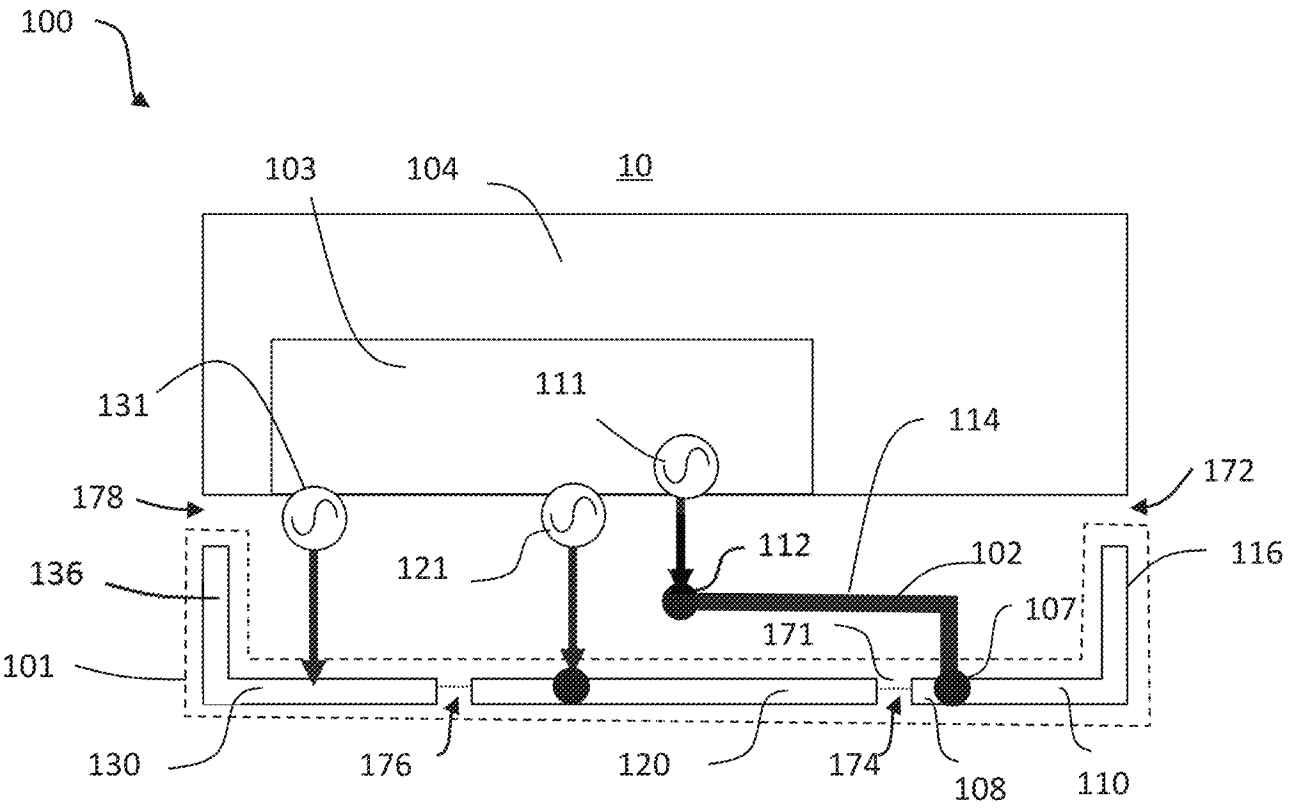
FIG. 1C is a block diagram illustrating a further example of an exemplary antenna system for a mobile device incorporating aspects of the disclosed embodiments.

Referring to FIG. 1C, in this example, the end portion or segment 116 of first corner segment 110 and the end portion or segment 136 of the second corner segment 130 are isolated from the metal chassis 104 of the mobile device 10 by gaps 172 and 178. The gaps 172 and 178 can be filled with a dielectric material, such as the dielectric material 171.

Figure 1D:
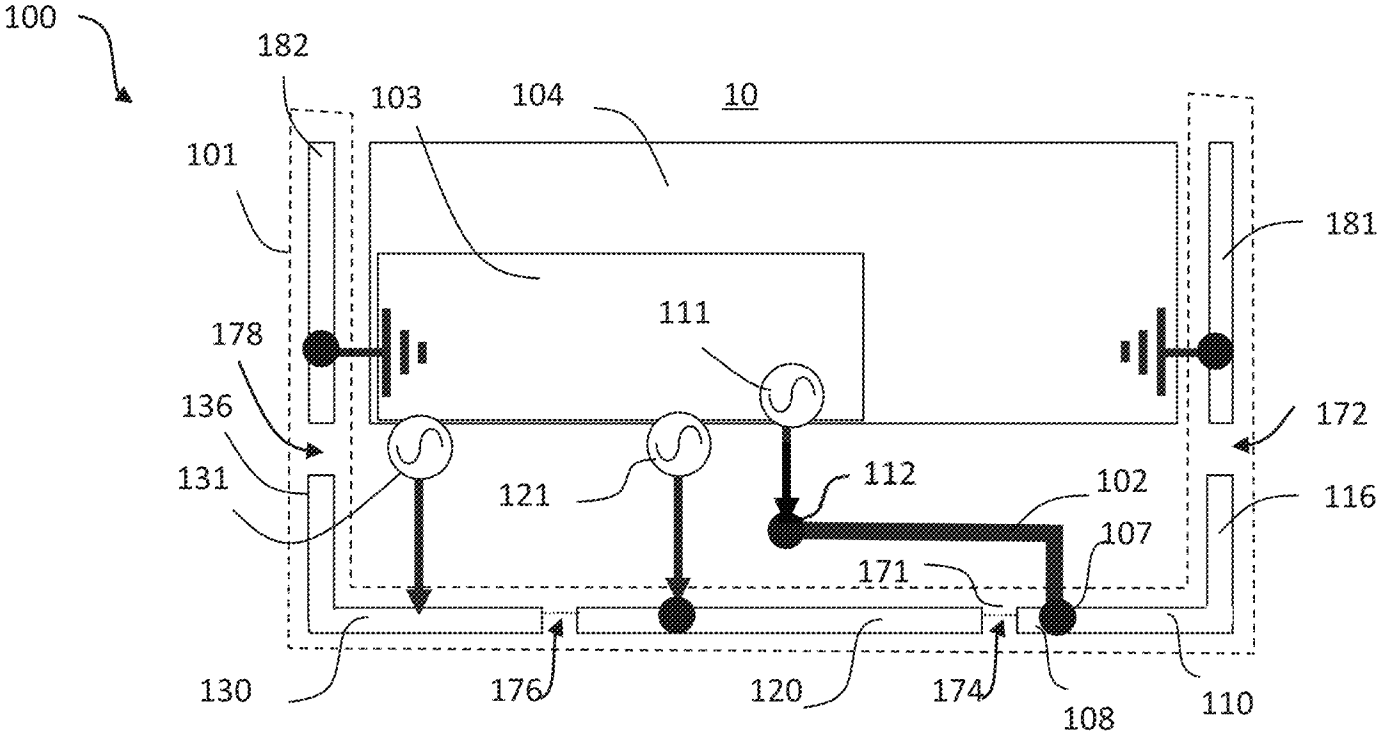
FIG. 1D is a block diagram illustrating a further example of an exemplary antenna system for a mobile device incorporating aspects of the disclosed embodiments.

In the example of FIG. 1D, the metal frame 101 is disposed around a perimeter of the mobile device 10. The first corner segment 110 and the second corner segment 130 are isolated from the metal chassis 104 by the dielectric filled gaps 172, 178. In this example, four physical gaps are created in the metal frame 101. This configuration can also allow the mid-high band antenna in the central segment 120 to be generally immune to left and right hand gripping of the mobile device 10, which provides more balanced right and left hand performance. In this example, the segments 181 and 182 of the metal frame 101 are connected to ground.

Figure 2A:
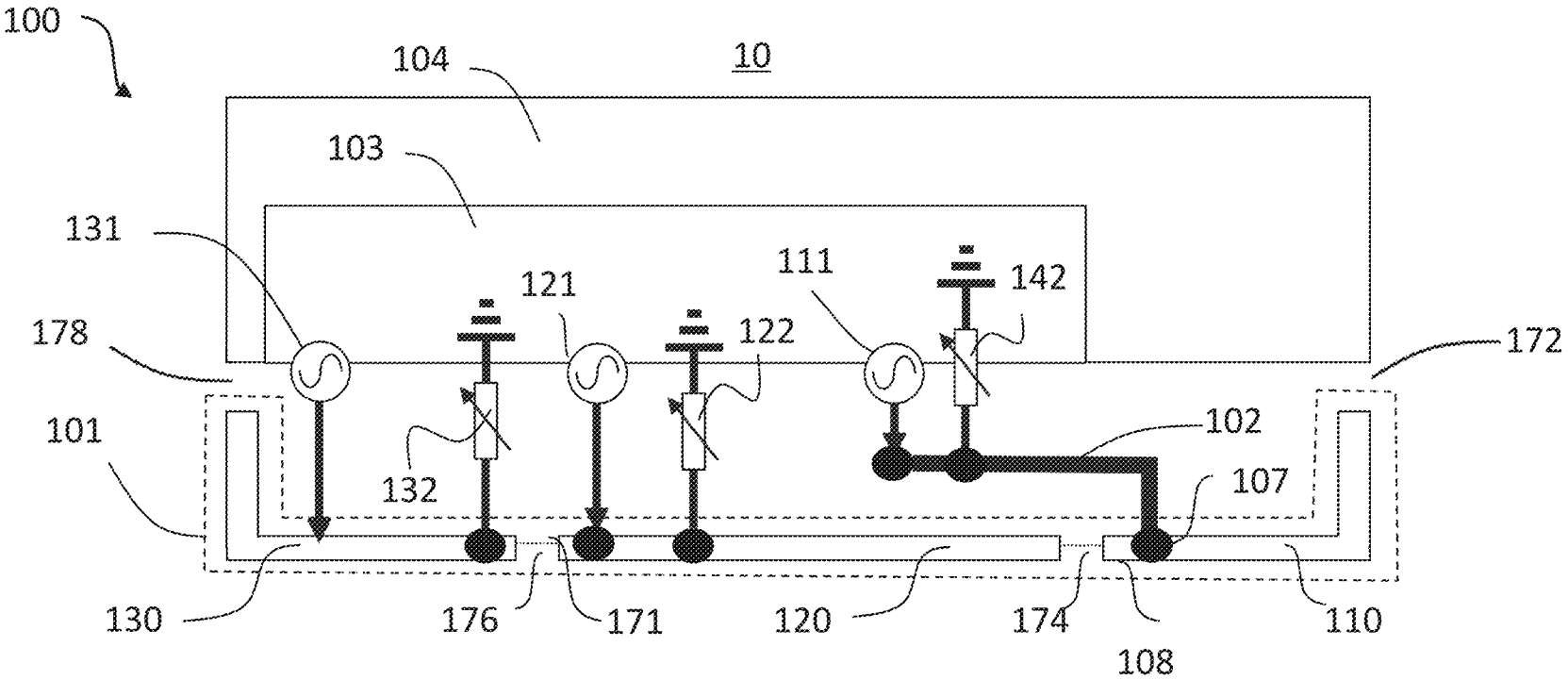
FIG. 2A is a schematic block diagram illustrating an exemplary antenna system for a mobile device incorporating aspects of the disclosed embodiments.

FIG. 2A illustrates another exemplary embodiment of antenna system 100 for a mobile device 10 incorporating aspects of the disclosed embodiments. In this example, as shown in FIG. 2A, the corner antenna 110 is connected to the second electrically conductive member 102, which is connected to the first feed or RF circuits 111. The first feed 111 can also be referred to as a low band feeding connection. In this example, the low band antenna is formed by the second electrically conductive member 102 connected to the first corner segment 110. The second electrically conductive member 102 and the first corner or low band antenna 110 are connected to RF circuits on the PCB 103 with the first feed or low band feeding connection 111 and a low band tunable impedance loading connection 142.

In the example of FIG. 2A, the central segment 120 is connected to the RF circuits on the PCB 103 with the second feed 121 and a tunable impedance loading connection 122. The second corner segment 130 is connected to the RF circuits on the PCB with the third feed 131 and a tunable impedance loading connection 132.

Figure 2B:
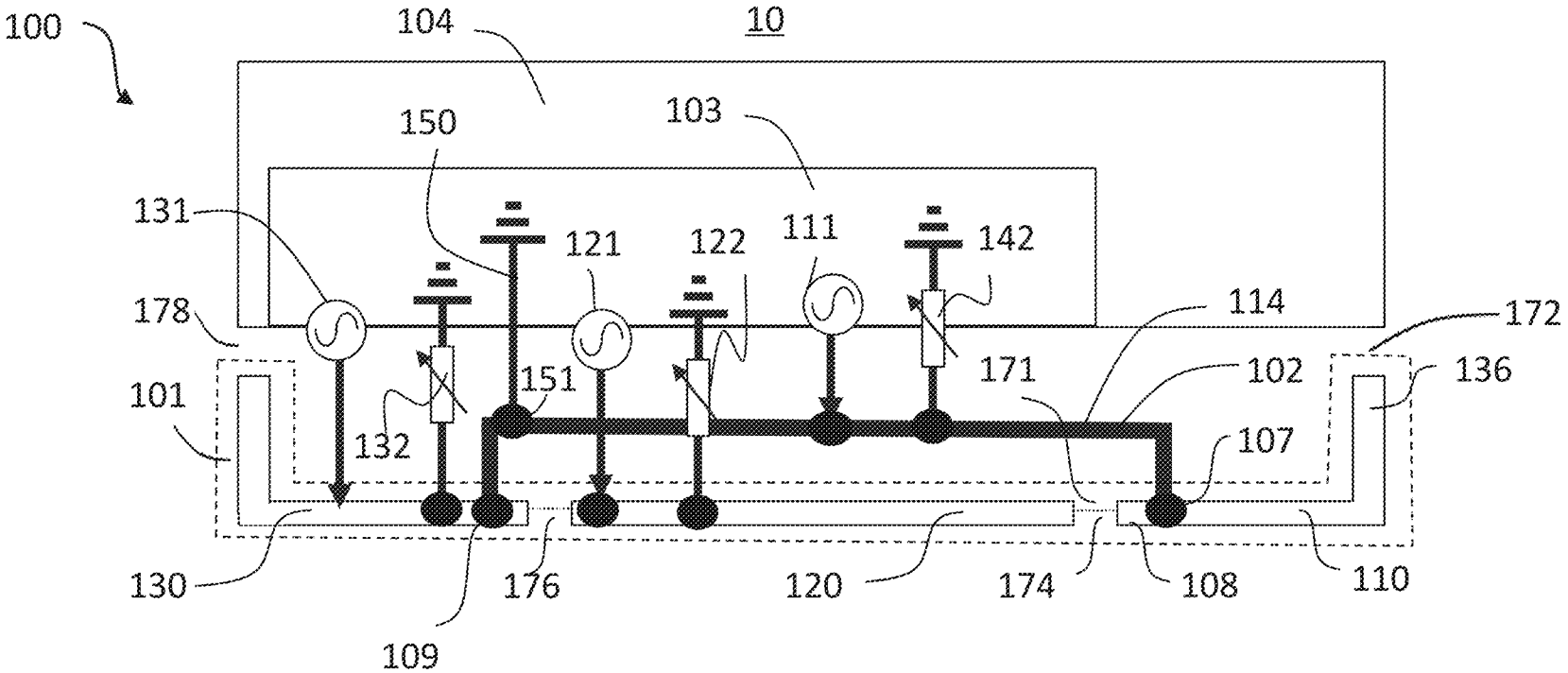
FIG. 2B is a schematic block diagram illustrating an exemplary antenna system for a mobile device incorporating aspects of the disclosed embodiments.

Referring to FIG. 2B, in one embodiment, the second corner antenna 130 is configured as a MIMO antenna operating at cellular mid-high frequency bands, such as for example, 1470 MHz-2700 MHz. The corner feed 131 is allocated to provide impedance matching for the structure and efficient antenna radiation. In one embodiment, the second corner antenna 130 is formed as inverted-F antenna by the grounding point 150 connection to the PCB 103. In this example, similar to the example of FIG. 2A, the second corner antenna 130 can further include a tunable impedance loading 132 connection to the PCB 103.

In one embodiment, the central segment or center antenna 120 is configured as another MIMO antenna operating in cellular mid-high frequency bands, for example 1470 MHz-2700 MHz. As shown in FIG. 2B for example, the center antenna 120 comprises a center part of the metal frame 101, which in this example is along the bottom portion 12 of the mobile device. A center feed 121 connects the center antenna 120 to RF circuits on the PCB 103, providing impedance matching for the structure and efficient antenna radiation.

As is also shown in the example of FIG. 2B, the center antenna 120 can further include at least one ground and impedance loading circuit or connection 122 to the PCB 103, providing a plurality of resonant frequencies within cellular mid-high frequency bands.

The center antenna 120 of the metal frame 101 in FIG. 2B is electrically isolated from the corner segments 110, 130 by the dielectrics-filled gaps 174 and 176 and generally orthogonal current modes. In this manner, the center antenna 120 is substantially isolated from the corner antenna 130 by at least 10 dB within operating cellular mid-high frequency bands.

In the example of FIGS. 2A and 2B, isolation between the low-band or corner antenna 110 and the center antenna 120 is provided by the impedance matching circuit or circuits 142 and the impedance matching circuit or circuits 122. In one embodiment, the impedance matching circuits 142 of the low-band feed 111 can be generally configured as a low-pass filter, and the impedance matching circuit or circuits 122 of the center feed 121 as a high-pass filter.

The allocation of the center antenna 120 provides maximum clearance from the adjacent metal parts of the mobile device 10. Open boundary conditions are defined in proximity to the sides and center of the mobile device 10, such as sides 14 and 16. This enables radiating a maximum E-field at the sides and center of the mobile device 10 and minimizing energy dissipation within user's hand and head.

In the examples of FIGS. 2A and 2B, the corner antennas 110 and 130 include feeding connections 111, 131, respectively, to corresponding circuits on the PCB 103. In some embodiment, the first corner antenna 110 can include at least one ground connection 151 and impedance loading connections 142 to corresponding circuits disposed for example on the PCB 103, providing plurality of resonant frequencies within cellular mid-high frequency bands. In one embodiment, the ground connection 151 for the first corner antenna 110 can be provided by internal conductive structures, further increasing antenna length and thus improving radiation efficiency. The first corner antenna 110, center antenna 120 and second corner antenna 130 can also have different antenna configurations, such as for example, monopole or ILA (inverted-L antenna), loop etc.

Figure 3:
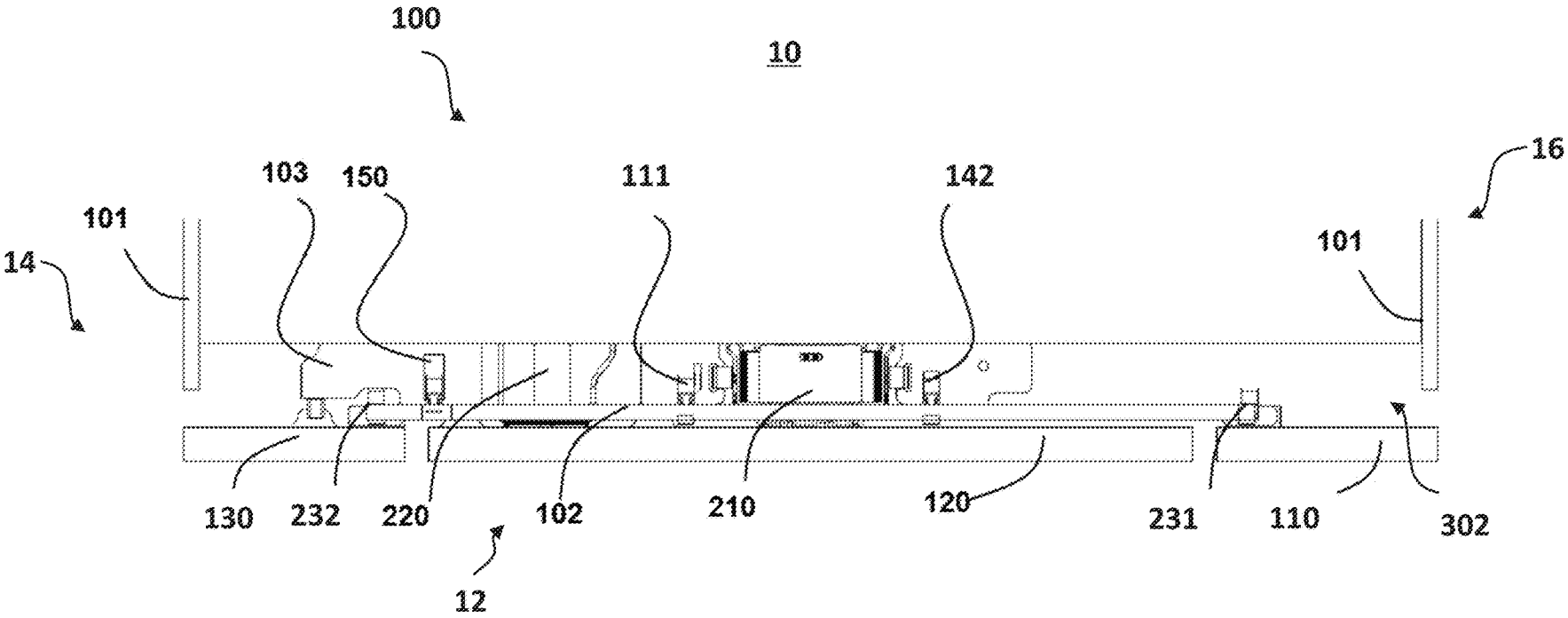
FIG. 3 is a front view of a bottom portion of a mobile device with an antenna system incorporating aspects of the disclosed embodiments.

FIG. 3 illustrates a front view of the bottom 12 and side portions 14, 16 of a mobile device 10 with an antenna system 100 including aspects of the disclosed embodiments. In this example, the second electrically conductive member 102 is formed by at least one conductor track disposed on or connected to a dielectric part of the mobile device 10, such as the PCB 103. The second electrically conductive element 102 enables spatial reuse. In this example, the first corner or low-band antenna 110 and the center antenna 120 and second corner antenna 130, or two mid-high band antennas utilize the same volume within the bottom portion 12 of the mobile device 10. Each antenna element 110, 120 and 130 is configured to radiate in at least one MIMO frequency band. In this manner, spatial reuse provides for the allocation of multiple antennas within what would otherwise be the same volume for a single antenna.

In one embodiment, the second electrically conductive member 102 can be disposed under a front glass cover, generally illustrated by 302, of the mobile device 10, which is also disposed above a Universal Serial Bus (USB) connector 210 and an audio-visual (AV) jack 220, as may be generally understood. In this example, the second electrically conductive member 102 is connected to the corner antenna 110 and the low-band antenna 130 via contact points or connections 231, 232. Low-band feed in and low-band tunable impedance loading 142 are conductively connected to the second electrically conductive structure 102.

As noted above, the embodiment of FIG. 3 provides three independent antenna elements: the first corner or low band antenna 110 and two mid-high band antennas, the center antenna 120 and the second corner antenna 130. In one embodiment, the two mid-high band antennas 120, 130 can be configured for 4×4 MIMO multiband operation. Each of the three independent antennas 110, 120, 130 can have a separate feeding connection, such as 111, 121, 131 shown in FIG. 2B, and independently configured multiband impedance matching 142, 122 and 132.

Figure 4:
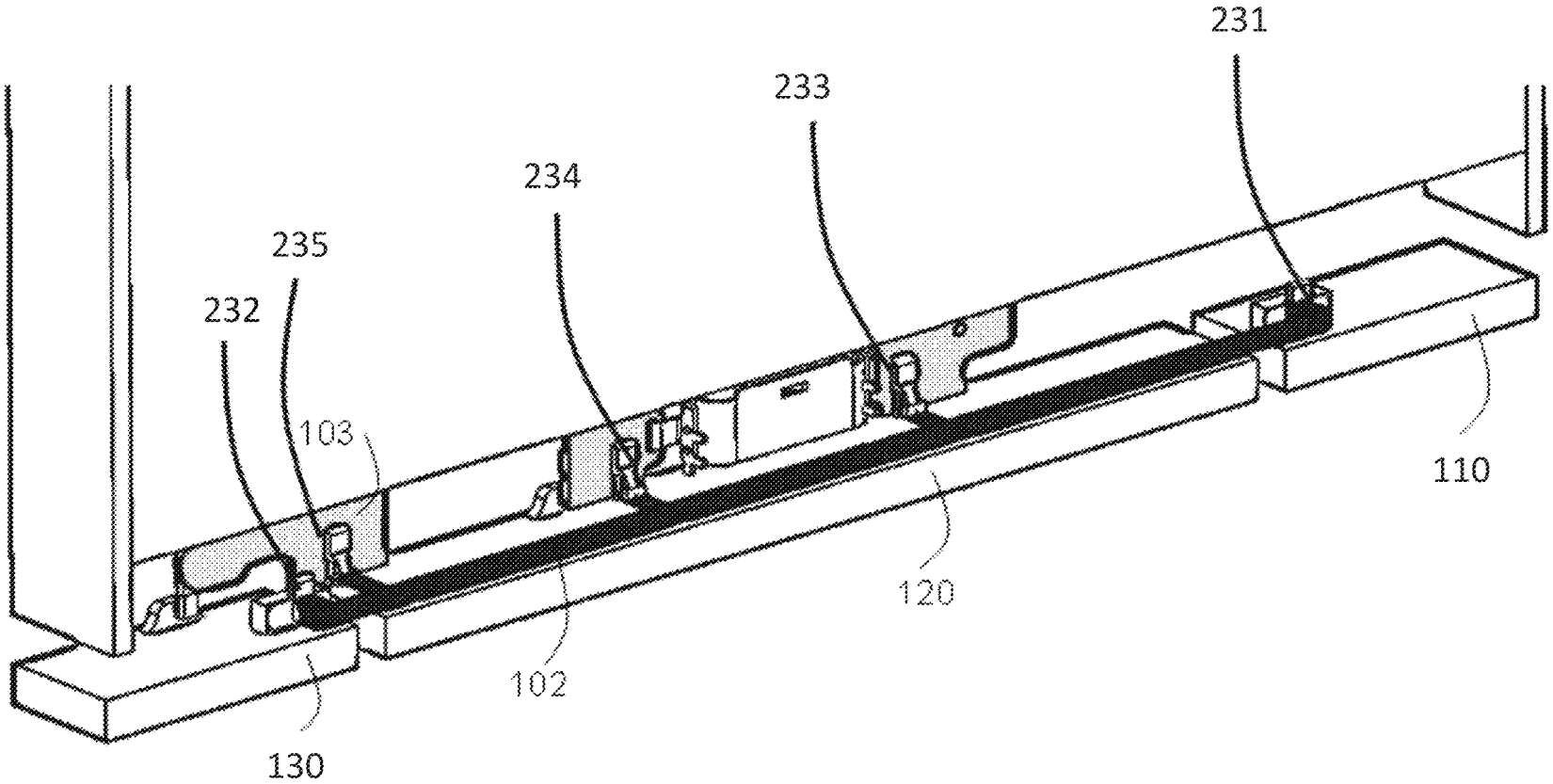
FIG. 4 is a perspective view of the front of the bottom portion of a mobile device with an antenna system incorporating aspects of the disclosed embodiments.
Figure 5:
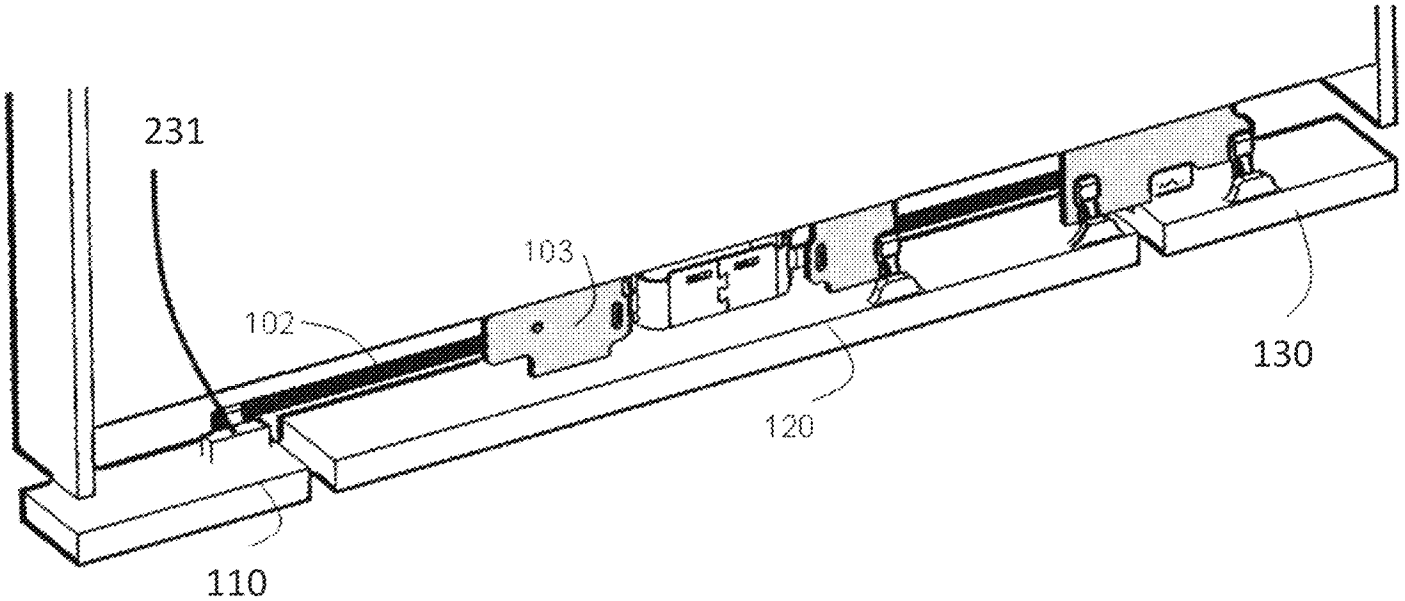
FIG. 5 is a perspective view of the back side of the bottom portion of a mobile device with an antenna system incorporating aspects of the disclosed embodiments.

FIGS. 4 and 5 illustrates one embodiment of the connections of the second electrically conductive member or structure 102 to the PCB 103 and the corresponding circuits. The examples of FIGS. 4 and 5 illustrate a perspective view of the front and back of the bottom portion 12 of a mobile device 10 that includes an antenna structure 100 incorporating aspects of the disclosed embodiments. In this example, connection points 231 and 232 generally illustrate an exemplary connection of the second electrically conductive member 102 to the first corner antenna 110 and the second corner antenna 130, respectively. Connection points 233, 234 and 235 illustrate exemplary connections for the feeding point 111, impedance circuits 142 and ground 150 illustrated in FIG. 2B, for example, to the second electrically conductive member 102. While certain connection points are illustrated in the example of FIGS. 4 and 5, also with respect to FIG. 2B, the aspects of the disclosed embodiments are not so limited. In alternate embodiments, the manner of connection and the order of connections can be any suitable or desired connection type.

Figure 6:
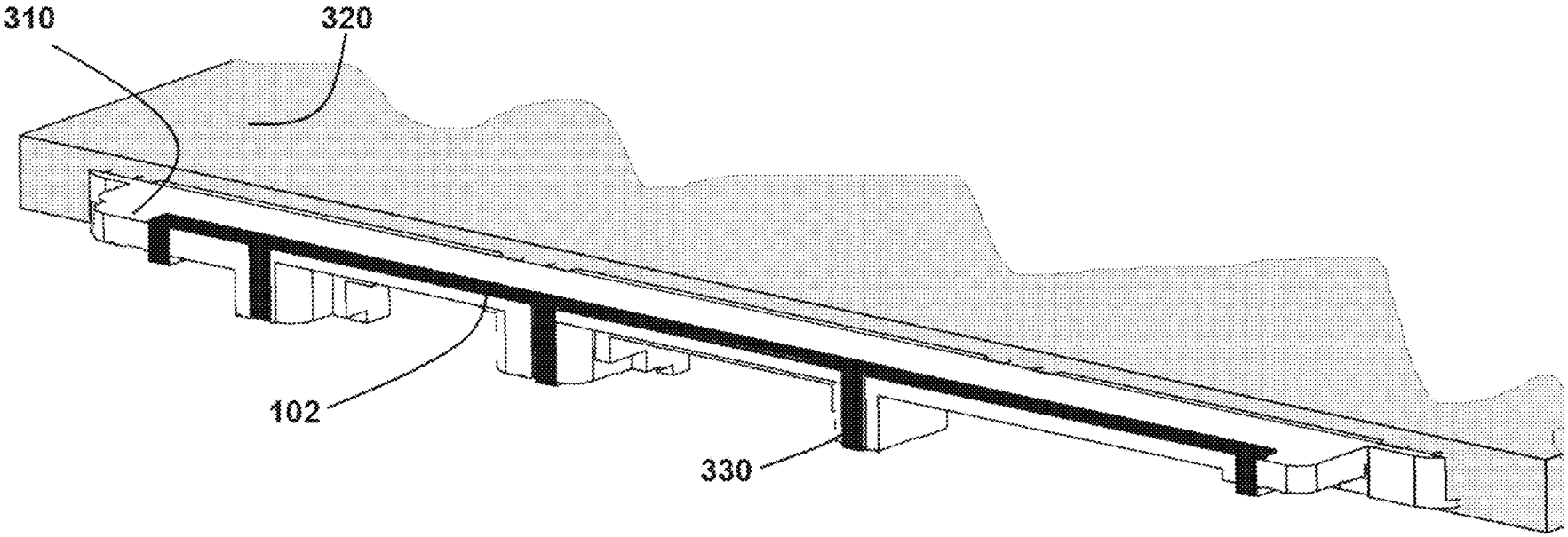
FIG. 6 is a perspective view of an exemplary internal electrically conductive member for an antenna system incorporating aspects of the disclosed embodiments.

FIG. 6 illustrates one example of the second electrically conductive structure 102. In this example, the second electrically conductive structure 102 is affixed to a plastic carrier 310 and metal parts 320 of the mobile device 10. Exemplary manufacturing methods for producing the second electrically conductive structure 102 can include, but are not limited to, fabrication of the conductive structure 102 as a separate Laser Direct Structuring (LDS) part; printing the conductive structure 102 using 3D printing technology, affixing a flexible PCB on a plastic carrier, stamping a metal part, inserting a moulded metal part, or as part of a metal ring itself. Connection points or contacts 330 are allocated for connection of the second electrically conductive structure 102 to the PCB 103 or metal frame parts, generally as shown with respect to FIGS. 4 and 5, for example. The connection points or contacts 330 generally comprise one or more of the connections points 231-235 illustrated in FIGS. 4 and 5.

Figure 7:
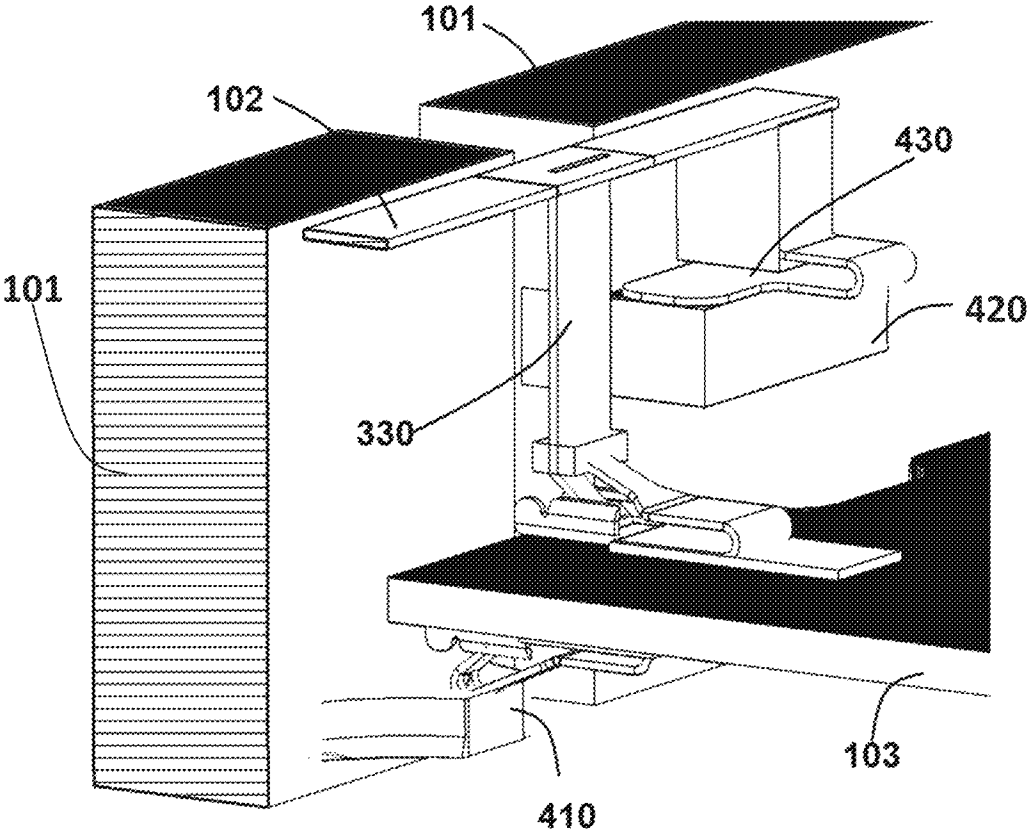
FIGS. 7 to 9 illustrate perspective views of an exemplary mechanical connection structure for an antenna system incorporating aspects of the disclosed embodiments.
Figure 8:
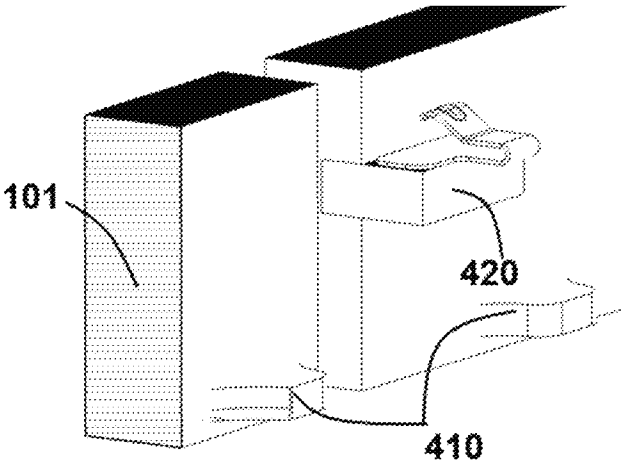
Figure 9:
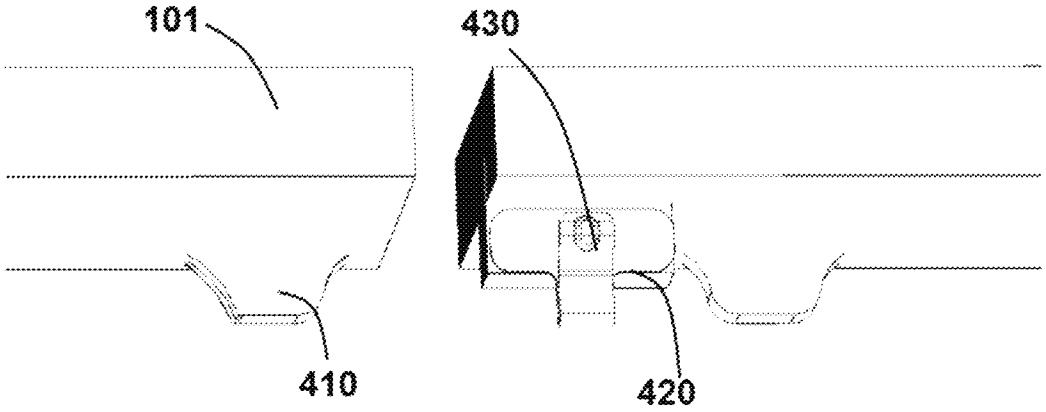

In one embodiment, referring also to FIGS. 7-9, the connection points or contacts 330 can comprise c-clip type members or contact points as a mechanical interface for the connection points 231-235 illustrated in FIGS. 4 and 5.

In the example shown in FIGS. 7-9, the connection points 330 generally comprise bus-stop members 410, 420 and c-clip type contacts 430. The bus stop members 410, 420 are shown in FIGS. 7 and 8 as being connected to the first electrically conductive member 101 and the second electrically conductive member 102 via c-clip members 430. The c-clip members 430 are shown in this example as being connected to the first electrically conductive member 101. Engagement of the bus stop or contact member 420 with a c-clip member 430 can be used to electrically connect the first electrically conducting member 101, or segments of the metal frame 104, to the second electrically conductive member 102 as is generally described herein.

The aspects of the disclosed embodiments provides a MIMO antenna arrangement, for example, main low-band antenna, main mid-high band antenna, multiband MIMO antenna or any combination thereof, or a complete MIMO antenna arrangement on its own. In one embodiment, this is enabled by configuring the operational frequency bands of the center antennas and the corner antennas to be at least partially overlapping. This configuration advantageously enables the antenna arrangement 100 of the disclosed embodiments to provide a MIMO antenna or a diversity antenna. In some embodiments, the operational frequency bands of center antennas and corner antennas may be Long Term Evolution (LTE) frequency bands.

Figure 10:
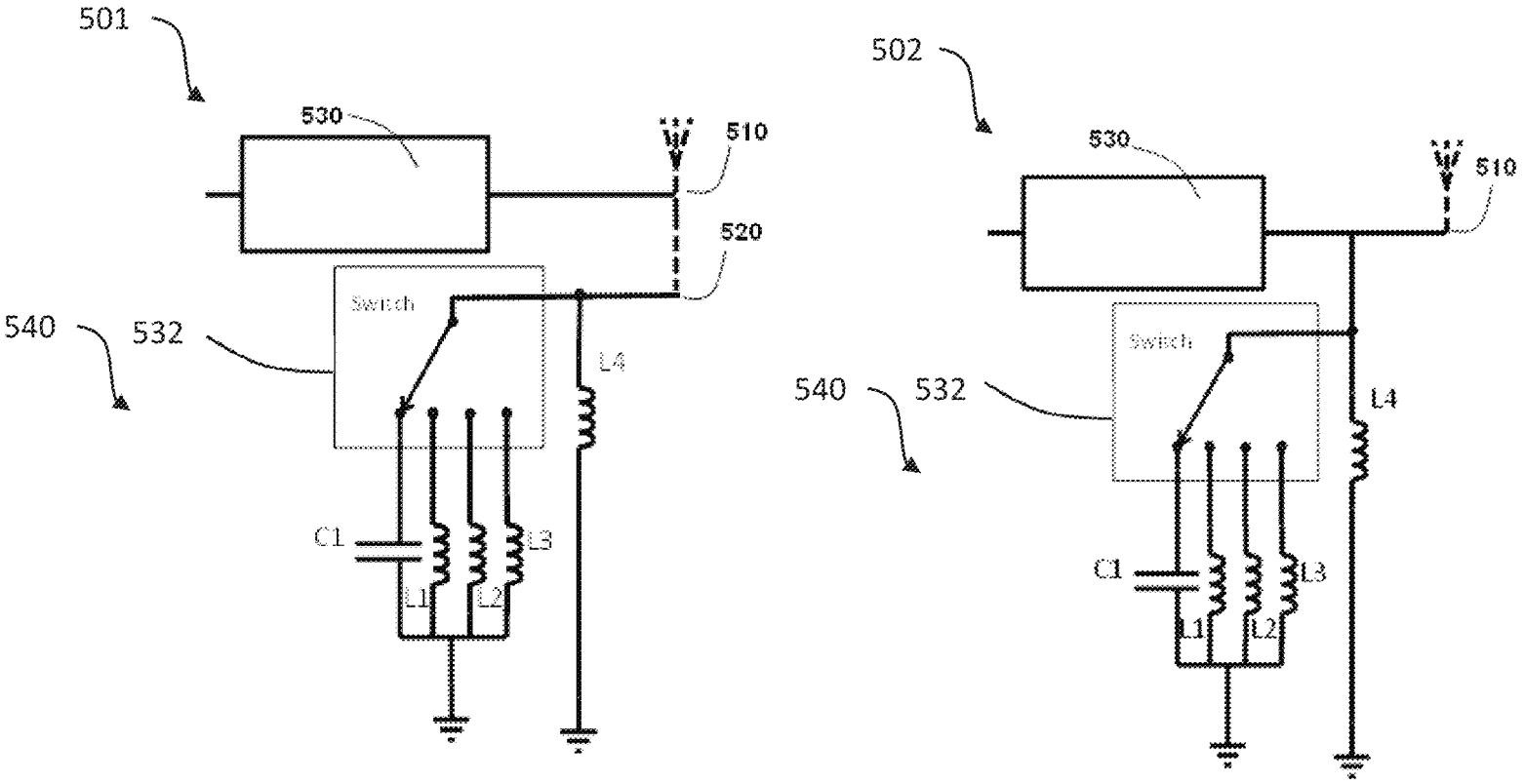
FIG. 10 illustrates exemplary switching circuits that can be used in an antenna system incorporating aspects of the disclosed embodiments.

Exemplary tuneable impedance matching circuits 501, 502 for embodiments of the antenna system 100 are illustrated in FIG. 10. The tuneable impedance matching circuits 501, 502 are generally utilized for providing multi-band operation of the MIMO antennas. For example, covering all low-frequency bands from B12 to B8. The exemplary circuits 501, 502 generally include a fixed matching circuit 530 and switching matching circuits 540. Exemplary embodiments of the switching matching circuits 532 can include an SPnT switch with different inductors L1, L2, L3 to the ground, including SPST, SPDT, SP4T, for example. While an SPnT type switch is described herein, the exemplary embodiments may include any type of switch realized in any suitable technology, such as for example as semiconductor (SOI, CMOS, GaAs, GaN etc), MEMS technology. Other embodiments of tuneable impedance matching circuits 501, 502 may utilize capacitance banks, varactors or other reconfigurable impedance circuits.

Referring still to FIG. 10, in one embodiment, the antenna feed connection 510 could be spatially separated from antenna tuneable impedance connection 520 as illustrated by circuit 502. In the example of circuit 502, separate contact points 231, 232 can be used, as illustrated with respect to FIGS. 4 and 5. Alternatively, as illustrated by the circuit 501, the antenna feed connection 510 could be co-allocated with antenna tuneable impedance connection 520.

One of the advantages of the antenna system 100 described herein is that a length of the second electrically conductive member 102 disclosed herein is independent of a geometry of the mobile device 10. Therefore, a length of the low-band antenna, such as the first corner antenna 110 described herein, can be adjusted to meet appropriate resonance conditions. For example, at a resonance frequency of 800 MHz, an efficiency of the low-band antenna 110 can be maximized within entire frequency band 698 MHz-960 MHz. Illustrations of low-band antenna frequency responses for various states of the switch 501, 502 shown in FIG. 10, are illustrated in FIGS. 11-14. Prototype measurement results included: −6.1 dB eff 80 MHz BW measured in B8; −5.8 dB 50 MHz BW measured at B12.

Figure 11:
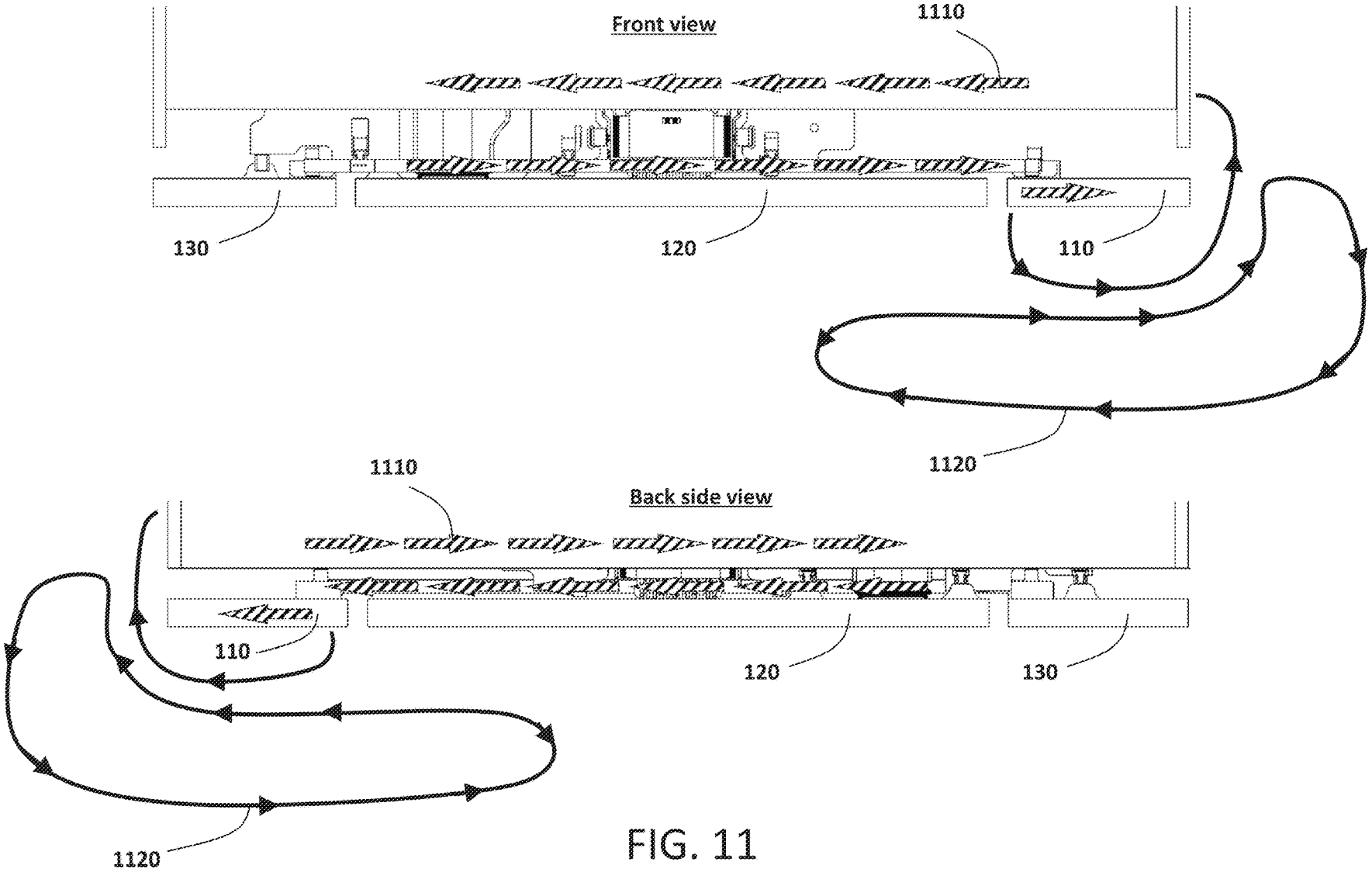
FIGS. 11 to 14 illustrate exemplary electromagnetic field flows for an antenna system incorporating aspects of the disclosed embodiments.

FIG. 11 illustrates operation of the first corner or low band antenna 110 at low-bands frequency range 699-960 MHz: surface currents distribution 1110 and E-field lines of force distribution 1120. According to the illustration in FIG. 11, the antenna 110 operates as a monopole or an IFA at low-bands frequency range.

Figure 12:
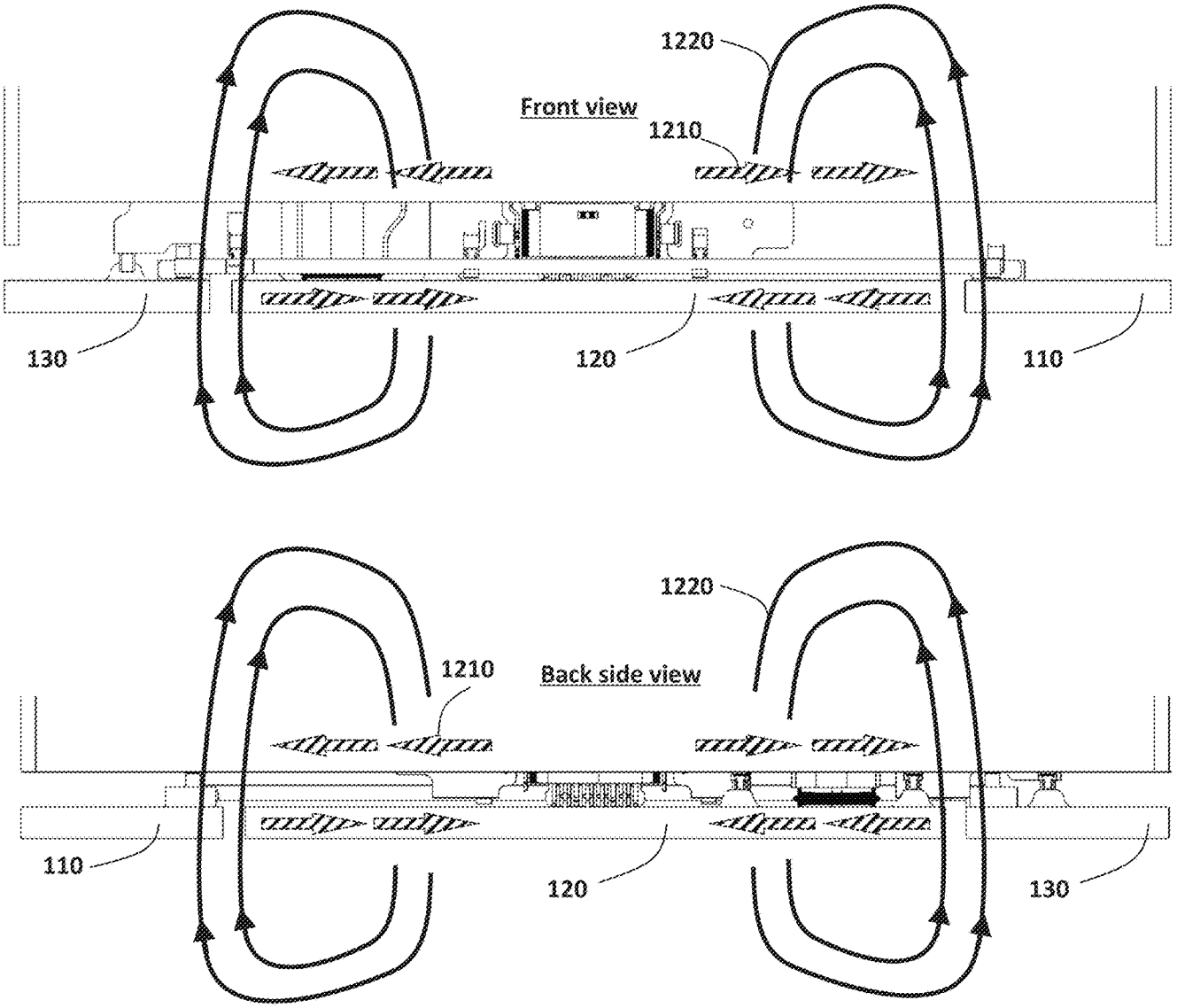

FIG. 12 illustrates an exemplary operation of the center segment or antenna 120 at high-bands frequency range (1900-2700 MHz). The surface currents distribution 1210 and E-field lines of force distribution 1220 are illustrated. According to the illustration of FIG. 12, the antenna 120 operates as a slot or a loop type antenna at high-bands frequency range.

Figure 13:
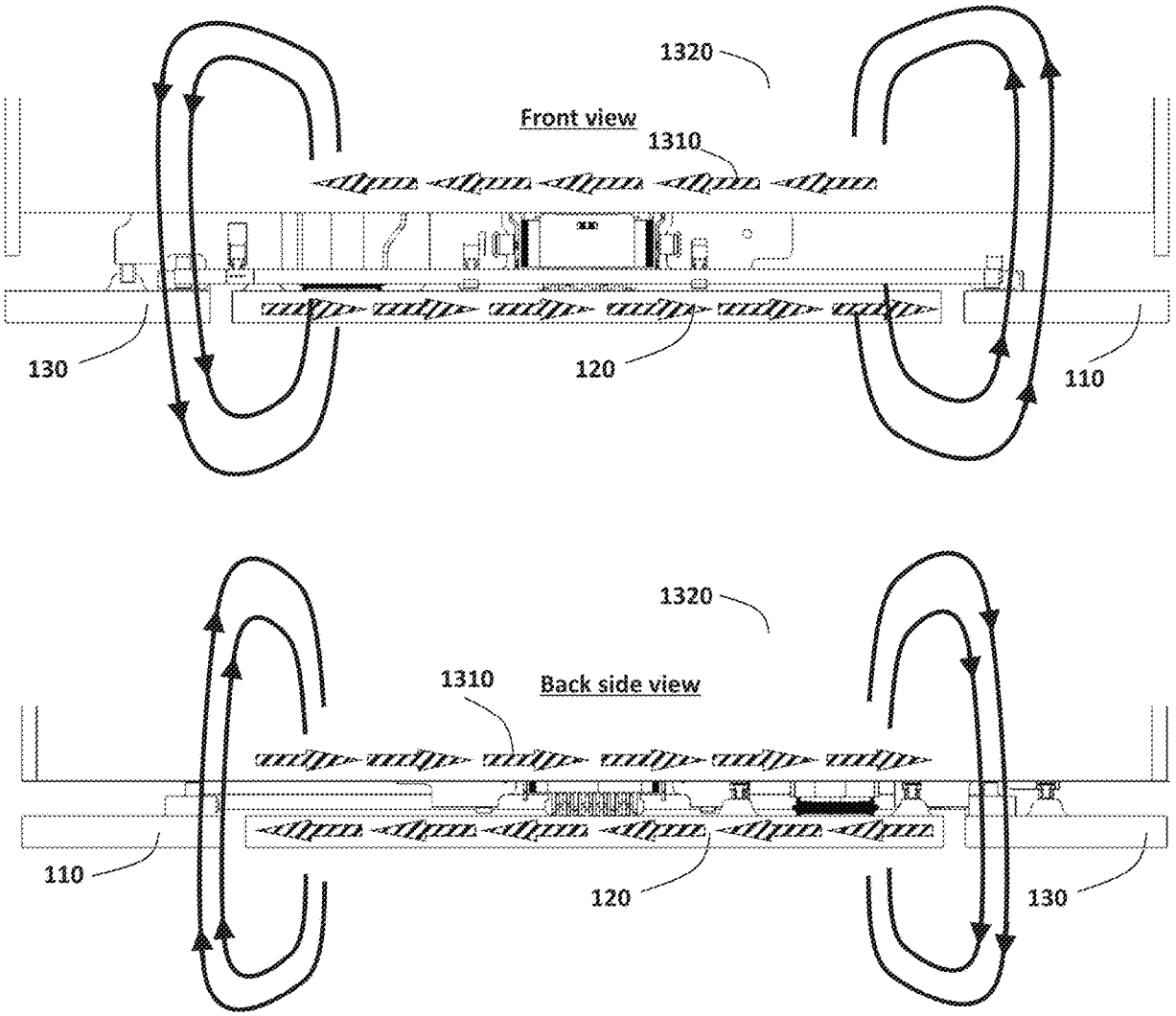

FIG. 13 illustrates an exemplary operation of the center segment or antenna 120 at low-bands frequency range (699-960 MHz), or at mid-bands frequency range (1450-1900 MHz). The surface currents distribution 1310 and E-field lines of force distribution 1320 are illustrated. According to the illustrations in FIG. 13, the center antenna 120 operates as a monopole or a IFA at low-bands frequency range.

Figure 14:
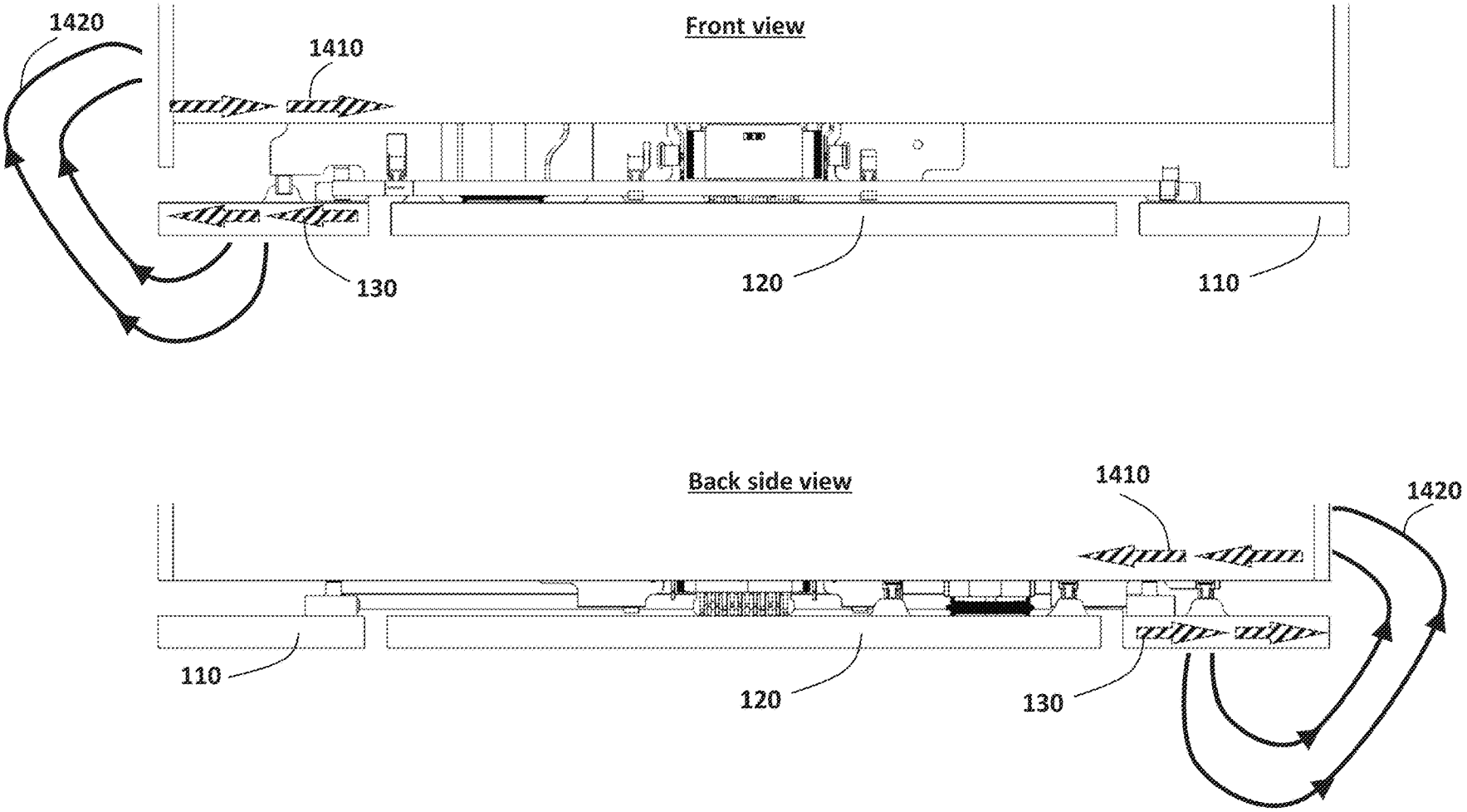

FIG. 14 illustrates operation of the second corner antenna 130 at mid-high bands frequency range (1700-2700 MHz). In this example, the surface currents distribution 1410 and E-field lines of force distribution 1420 are illustrated. According to the illustration in FIG. 15, the second corner antenna 130 operates as a monopole or an IFA at mid-high bands frequency range.

FIGS. 11-14 illustrates radiation modes of the antennas 110, 120, 130 at cellular frequency bands, their orthogonally and mutual isolation. Surface currents distributions 1410 of the first corner antenna 110 are not overlapping in space with surface currents distributions 1110 of the second corner antenna 130. Thus high isolation between the corner antennas 110 and 130 is achieved.

In FIGS. 11-14, the surface currents distributions mo of first corner antenna 110 are partially overlapping in space with surface currents distributions 1210, 1310 of the center antenna 120. Thus isolation between antennas 120 and no is achieved by separating their feeding connections 121, 111 respectively and operating antennas 120 and no at non-overlapping frequency bands. In some embodiments, the first corner antenna 110 can be operated at low frequency bands, while the center antenna 120 is operating at mid-high frequency bands. In yet another embodiments, antenna 130 is operating at mid-high frequency bands, antenna 120 is operating at low frequency bands.

The aspects of the disclosed embodiments provide an antenna system for a mobile device that has separate and independent multiple-input multiple-output (MIMO) antennas. The antenna system of the disclosed embodiments makes use of the exterior metal frame, metal back cover and internal conductive member to provide separate and independent antenna systems. The separate and independent antennas enable multiband 4×4 MIMO operation of the cellular communication networks.

Thus, while there have been shown, described and pointed out, fundamental novel features of the invention as applied to the exemplary embodiments thereof, it will be understood that various omissions, substitutions and changes in the form and details of devices and methods illustrated, and in their operation, may be made by those skilled in the art without departing from the spirit and scope of the presently disclosed invention. Further, it is expressly intended that all combinations of those elements, which perform substantially the same function in substantially the same way to achieve the same results, are within the scope of the invention. Moreover, it should be recognized that structures and/or elements shown and/or described in connection with any disclosed form or embodiment of the invention may be incorporated in any other disclosed or described or suggested form or embodiment as a general matter of design choice. It is the intention, therefore, to be limited only as indicated by the scope of the claims appended hereto.

What is claimed is:

1. A system comprising:

a first electrically conductive member in a mobile device, the first electrically conductive member comprising a plurality of segments, the plurality of segments comprising a first corner segment, a second corner segment, and a central segment, the central segment being disposed adjacent to and between the first corner segment and the second corner segment, a first dielectric material is disposed between the first corner segment and the central segment, and a second dielectric material is disposed between the second corner segment and the central segment; and a second electrically conductive member disposed within the mobile device, the second electrically conductive member comprising:

a first end of the second electrically conductive member connected to the first corner segment; and a portion of the second electrically conductive member opposite the first end electrically connected to a first feeding portion, wherein the central segment is connected to a second feeding portion, and the second corner segment is connected to a third feeding portion, and wherein a second end of the second electrically conductive member is electrically connected to the second corner segment.

2. The system according to claim 1, wherein the second electrically conductive member comprises a segment that is parallel to the central segment.

3. The system according to claim 1, wherein the mobile device comprises a metal chassis, wherein an end of the first corner segment opposite to the central segment is electrically connected to the metal chassis.

4. The system according to claim 1, wherein the mobile device comprises a metal chassis, wherein a third dielectric material is disposed between the metal chassis and an end of the first corner segment opposite the central segment.

5. The system according to claim 4, wherein an end of the second corner segment opposite the central segment is electrically connected to the metal chassis.

6. The system according to claim 4, wherein a fourth dielectric material is disposed between the metal chassis and an end of the second corner segment opposite the central segment.

7. The system according to claim 6, wherein a frame of the mobile device comprises the first electrically conductive member.

8. The system according to claim 6, wherein the first to fourth dielectric materials are the same dielectric material.

9. The system according to claim 4, wherein the metal chassis comprises a back cover of the mobile device.

10. The system according to claim 1, further comprising a ground connection disposed at a point on a segment of the second electrically conducting member that is farthest from the first end of the second electrically conducting member.

11. The system according to claim 10, wherein the central segment of the first electrically conductive member is disposed along a bottom side of the mobile device.

12. The system according to claim 11, wherein the second electrically conductive member comprises a conductive track on a dielectric portion of the mobile device.

13. The system according to claim 12, wherein the first corner segment is disposed in a first corner area of the mobile device.

14. The system according to claim 13, wherein the second corner segment is disposed in a second corner area of the mobile device.

15. The system according to claim 1 further comprising an impedance loading circuit connected to the second electrically conductive member.

16. The system according to claim 1, wherein the first electrically conductive member comprises an antenna contact member with a c-clip member, wherein the second electrically conductive member comprises a c-clip contact point, and wherein an engagement of the antenna contact member with the c-clip member electrically connects the first electrically conductive member to the second electrically conductive member.

17. The system according to claim 1, wherein the mobile device comprises a frame having a relatively small top side and a relatively small bottom side, a relatively long first side and a relatively long second side, the relatively small top side is connected by the relatively long first and second sides to the relatively small bottom side, wherein the central segment is disposed along the bottom side, wherein the first corner segment is disposed in a first corner area of the bottom side and the first side and the second corner segment is disposed in a second corner area of the bottom side and the second side, wherein a third dielectric material is disposed between a first segment of the first side and an end of the first corner segment opposite to the central segment, and wherein a fourth dielectric material is disposed between a second segment of the second side and an end of the second corner segment opposite to the central segment.

18. A system comprising:

a first electrically conductive member in a mobile device, the first electrically conductive member comprising a plurality of segments, the plurality of segments comprising a first corner segment, a second corner segment, and a central segment, the central segment being disposed adjacent to and between the first corner segment and the second corner segment, a first dielectric material is disposed between the first corner segment and the central segment, and a second dielectric material is disposed between the second corner segment and the central segment; and a second electrically conductive member disposed within the mobile device, the second electrically conductive member comprising:

a first end of the second electrically conductive member connected to the first corner segment; and a portion of the second electrically conductive member opposite the first end electrically connected to a first feeding portion, wherein the central segment is connected to a second feeding portion, and the second corner segment is connected to a third feeding portion, wherein the first electrically conductive member comprises an antenna contact member with a c-clip member, wherein the second electrically conductive member comprises a c-clip contact point, and wherein an engagement of the antenna contact member with the c-clip member electrically connects the first electrically conductive member to the second electrically conductive member.

19. The system according to claim 18, wherein the first and second dielectric materials are the same dielectric material.

20. The system according to claim 18, further comprising a ground connection disposed at a point on a segment of the second electrically conducting member that is farthest from the first end of the second electrically conducting member.

* * * * *